US009990878B2

(12) United States Patent
Heo et al.

(10) Patent No.: US 9,990,878 B2
(45) Date of Patent: Jun. 5, 2018

(54) DATA CLIPPING METHOD USING RED, GREEN, BLUE AND WHITE DATA, AND DISPLAY DEVICE USING THE SAME

(71) Applicant: LG DISPLAY CO., LTD., Seoul (KR)

(72) Inventors: Cheon Heo, Gyeonggi-do (KR); Kyungjoon Kwon, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 335 days.

(21) Appl. No.: 14/940,908

(22) Filed: Nov. 13, 2015

(65) Prior Publication Data

US 2016/0140924 A1 May 19, 2016

(30) Foreign Application Priority Data

Nov. 14, 2014 (KR) ..... 10-2014-0159175

(51) Int. Cl.
*G09G 3/20* (2006.01)

(52) U.S. Cl.
CPC ... *G09G 3/2003* (2013.01); *G09G 2300/0452* (2013.01); *G09G 2340/06* (2013.01); *G09G 2360/16* (2013.01)

(58) Field of Classification Search
None
See application file for complete search history.

(56) References Cited

U.S. PATENT DOCUMENTS

| | | | | |
|---|---|---|---|---|
| 7,486,417 | B2 * | 2/2009 | Baek, II | G09G 3/3607 345/600 |
| 7,782,335 | B2 * | 8/2010 | Baek, II | G09G 3/3607 345/586 |
| 2006/0256053 | A1 * | 11/2006 | Baek, II | G09G 3/3607 345/88 |
| 2008/0198180 | A1 * | 8/2008 | Langendijk | G09G 3/2003 345/690 |

FOREIGN PATENT DOCUMENTS

| | | | |
|---|---|---|---|
| CN | 1987987 | A | 6/2007 |
| CN | 102034116 | A | 4/2011 |
| KR | 10-2006-0117025 | | 11/2006 |
| KR | 10-2006-0133194 | | 12/2006 |
| KR | 10-2007-0011830 | | 1/2007 |
| KR | 10-2007-0080140 | | 8/2007 |
| TW | 200701146 | A | 1/2007 |

* cited by examiner

*Primary Examiner* — David D Davis
(74) *Attorney, Agent, or Firm* — Dentons US LLP

(57) ABSTRACT

A data clipping method using red, green, blue and white data, and a display device using the same are disclosed. Red (R), Green (G), Blue (B), and White (W) data are modulated by multiplying clipped data of an input image by a gain, a luminance increment is created based on the result of subtracting the clipped data from the modulated RGB data, and the luminance increment is added to the W data to be written to a W sub-pixel.

8 Claims, 12 Drawing Sheets

FIG. 1A
(RELATED ART)
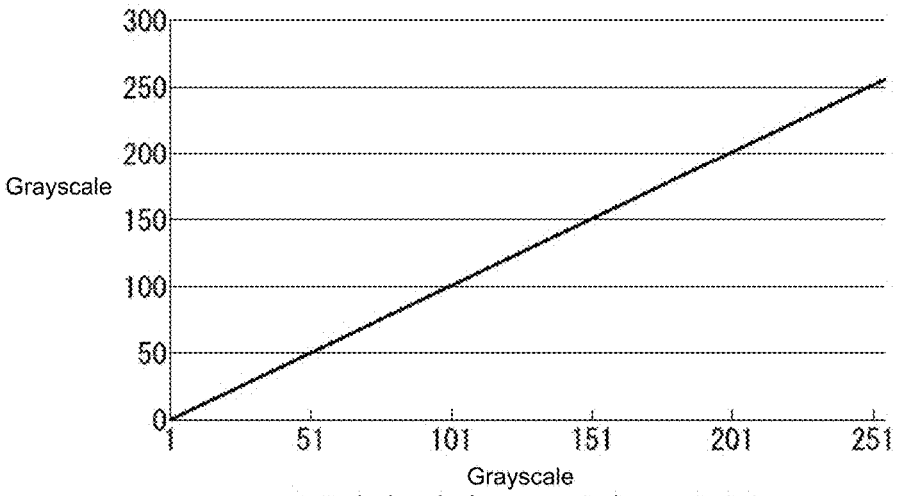
< Original image, Gain = 1.0 >
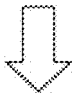
FIG. 1B
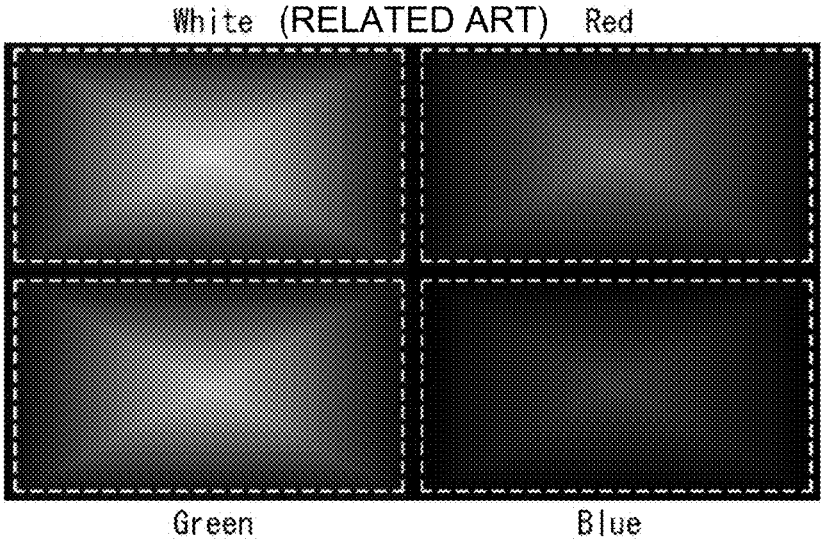

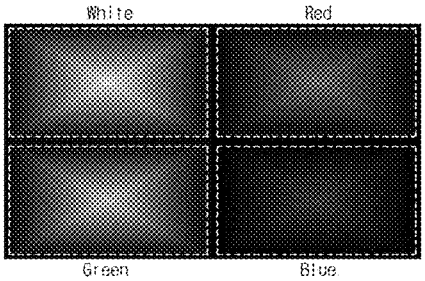
FIG. 8A Input image
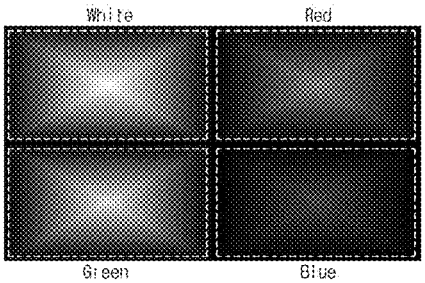
FIG. 8B Image multiplied by gain
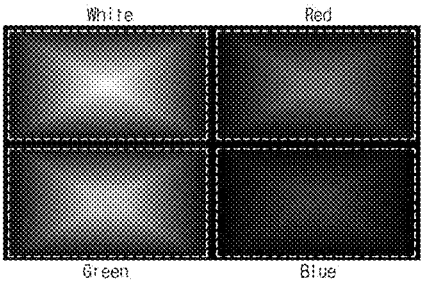
FIG. 8C Clipped image
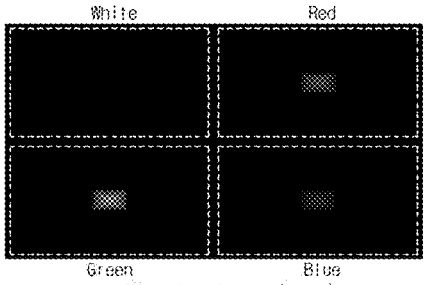
FIG. 8D Difference image (b − c)
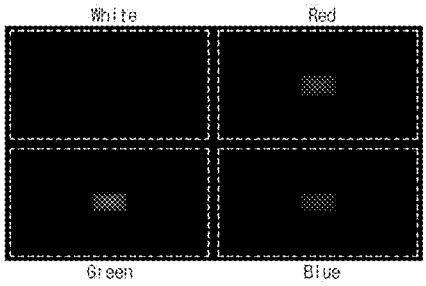
FIG. 8E White image to be added
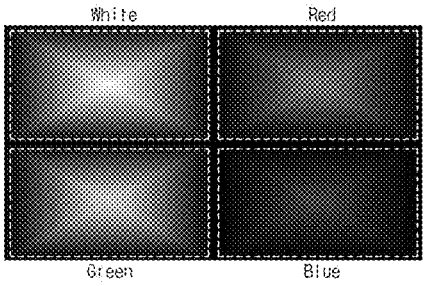
FIG. 8F Output image (c + e)

DATA CLIPPING METHOD USING RED, GREEN, BLUE AND WHITE DATA, AND DISPLAY DEVICE USING THE SAME

CROSS REFERENCE TO RELATED APPLICATIONS

This application claims the benefit of Korean Patent Application No. 10-2014-0159175 filed on Nov. 14, 2014, the entire contents of which are incorporated by reference for all purposes as if fully set forth herein.

BACKGROUND

Field of the Disclosure

The present disclosure relates to a data clipping method for driving a display device and a display device using the same.

Discussion of the Related Art

Data clipping can be used to boost the luminance of lower grayscales to improve displayed electronic images as an alternative to increasing light output from an electronic display device. A data clipping method is a method in which highest grayscale pixel data is clipped from a histogram of an input image and multiplied by a gain to modulate the pixel data. A data clipping method will be described with reference to FIGS. 1A to 3B.

For an original test image of FIGS. 1A and 1B, data can be clipped as shown in FIGS. 2A, 2B, 3A, and 3B. The original image of FIG. 1B is divided into four regions: red (R), green (G), blue (B), and white (W) regions. The grayscale at the outermost edge of each of the red (R), green (G), blue (B), and white (W) regions is 0. The grayscale gradually increases toward the center of the region, and the pixel data at the center of each region has the highest grayscale, 255.

The graphs in FIGS. 1A, 2A and 3A plot the input grayscale along the X-axis and the output grayscale along the Y-axis.

The data clipping method of FIG. 2A is an example of hard-clipping pixel data including multiplying the original pixel data by a gain of 1.5. In the example of FIG. 2A, data from grayscales 171 to 255 is clipped and saturated at the data of the highest grayscale. In this case, data at high grayscales of 171 to 255 are saturated at data equal to that of grayscale 255 of the original test image. In this condition, an observer will experience a severe degradation in picture quality because this method effectively reduces the number of grayscales in the image and loses detail at the highest grayscales. In the data clipping method of FIG. 2A, the red (R), green (G), and blue (B) grayscales are saturated, whereas the white grayscale is not saturated, as illustrated in FIG. 2B.

The white grayscale is not saturated because, in an LCD, a portion of white luminance is represented by mixing light having R+G+B wavelengths generated by RGB sub-pixels and a portion of white luminance is also represented by light generated by a white (W) sub-pixel. Thus, in an LCD, because white light is represented by driving all the R+G+B+W sub-pixels, white luminance corresponding to grayscale 255 may be obtained even when a grayscale of W sub-pixel data is lower than 171. In case of an OLED Display, white luminance may be presented by driving only a W sub-pixel.

White data is obtained from RGB data received as an input image using a known white gain calculation algorithm. A spectrum exchanging method is known as one method using the algorithm. In the spectrum exchanging method, in order to reduce an amount of light having RGB wavelengths of RGB sub-pixels by an amount of light having RGB wavelengths generated by only a W sub-pixel, RGB data written in RGB sub-pixels is subtracted, and W data equivalent to the subtracted data value is generated to increase luminance of the W sub-pixel to compensate for the lowered white luminance of the RGB sub-pixels. In the case of an LCD, a portion of target white luminance is represented by mixing light generated by the RGB sub-pixels, and the other luminance is represented by luminance of the W sub-pixel. Thus, in the above example, even though the grayscale of the W data is not 171, white luminance corresponding to grayscale 255 may be obtained, and thus, grayscale of W data is not saturated.

FIGS. 3A and 3B show an example of soft clipping in which the gain is 1.5 before a point of inflection and less than 1 for grayscales above the point of inflection. It is difficult to achieve more than a certain level of grayscale representation in the soft clipping method due to a point of inflection caused when pixel data is multiplied by a gain.

FIG. 4 is a flowchart showing a control procedure for a data clipping method according to the related art.

Referring to FIGS. 4-6, in the data clipping method of the related art, the histogram of an input image is created, and the maximum frame value, frame_max, is calculated in consideration of data clipping. In this data clipping method, the number of pixels at each grayscale is accumulated starting from the highest grayscale successively downward in the histogram, and the count is continued until the total accumulated count value exceeds a predetermined threshold. The last grayscale just before the total count value exceeds the threshold is defined as the maximum frame value, frame_max, (S101 and S102). Pixel data at grayscales higher than the maximum frame value is clipped.

Once the maximum frame value, frame_max, is defined, the frame gain, frame_gain, is calculated. The frame gain frame_gain is calculated by dividing the highest grayscale, i.e., 255, by the maximum frame value, frame_max (S103). Pixel data can be clipped as shown in FIGS. 2A and 3A by modulating pixel data by multiplying the input pixel data by the frame gain (S104 and S105). The pixel data clipped at grayscales above the maximum frame value exceeds the highest grayscale value when multiplied by a gain, and is therefore substituted by the highest grayscale, i.e., 255. The data clipping improves the luminance of pixels at grayscales below the maximum frame value. The output of a backlight used to illuminate a liquid crystal display panel can be reduced by the amount according to an increase in the luminance of pixels in a liquid crystal display device, thereby reducing power consumption of the device.

Although the data clipping method can be used to increase the luminance of pixels at lower grayscales, the pixel luminance may not be increased depending on the image. FIG. 5 is an example of a histogram of a dark image. FIG. 6 is an example of a histogram of a bright image. In FIGS. 5 and 6, the x axis represents grayscales as the bins of the histogram, and the y axis represents the cumulative number of pixels for each bin (grayscale) of the histogram.

For the dark image of FIG. 5, the luminance of pixels can be increased by the amount of data clipping at grayscales above the maximum frame value frame_max. On the other hand, for the bright image of FIG. 6, the cumulative number of pixels for high grayscales is large, and therefore a higher grayscale is defined as the maximum frame value. Thus, the grayscales of pixels are saturated at high grayscales when pixel data is modulated with the frame gain. To avoid high-grayscale saturation, the bright image has little increase in luminance.

SUMMARY

An aspect of this disclosure is to describe a data clipping method which can increase the luminance of pixels by improving high-grayscale saturation caused by data clipping, with the use of white data (hereinafter, referred to as 'W data') written to a white sub-pixel (hereinafter, referred to as 'W sub-pixel'), and increase the frame gain. Another aspect of this disclosure is to describe a display device using the same.

An exemplary embodiment of the present disclosure provides a data clipping method comprising: clipping high grayscales from an input image; modulating RGBW data of the input image by multiplying the clipped data of the input image by a gain; and creating a luminance increment based on the result of subtracting the clipped data from each of the modulated RGB data and adding the luminance increment to the W data to be written to a W sub-pixel.

Another exemplary embodiment of the present disclosure provides a display device comprising: a display panel with each pixel comprising an R sub-pixel, a G sub-pixel, a B sub-pixel, and a W sub-pixel; and a display panel driver for writing RGBW data to the pixels of the display panel.

The display panel driver comprises a data clipping module for executing the data clipping method.

One aspect of the exemplary embodiments includes a data clipping method for an electronic display device comprises inputting grayscales of Red (R), Green (G), Blue (B) and White (W) input image data for RGBW sub-pixels of the electronic display device; modulating the RGB input image data by multiplying the RGB input image data by a gain to obtain RGB modulated data; clipping the RGB modulated data into RGB clipped data by reducing corresponding data at grayscales; determining a luminance increment by adding the clipped data from each of modulated RGB data; adding the luminance increment to W data; and writing the W data to a W sub-pixel.

Another aspect of the exemplary embodiments includes a display device comprising a display panel including a plurality of pixels in a matrix, each pixel comprising a Red (R) sub-pixel, a Green (G) sub-pixel, a Blue (B) sub-pixel, and a White (W) sub-pixel; and a display panel driver for writing RGBW data to the pixels of the display panel, wherein the display panel driver clips grayscales from an input image, modulates RGBW data of the input image by multiplying clipped data of the input image by a gain, and creates a luminance increment based on the result of subtracting the clipped data from the modulated RGB data, and adds the luminance increment to the W data to be written to a W sub-pixel.

In another aspect of the exemplary embodiments a method of supplying clipped data to an electronic display device that includes red (R), green (G), blue (B), and white (W) sub-pixels of an electronic display panel, comprises inputting grayscale Red, Green, and Blue (RGB) input image data into the electronic display device; generating RGBW image data from the RGB input image data; multiplying the RGBW image data by a frame gain to calculate RGB modulated data; clipping the RGB modulated data by setting RGB data at a grayscale above a predetermined grayscale to be equal to data at a maximum grayscale to generate RGB clipped data; subtracting the RGB clipped data from the RGB modulated data to calculate RGB output data; generating a luminance increment based on the RGB output data; adding the luminance increment to the W data to calculate W output data; combining RGB output data with W output data; and outputting the RGBW output data to the electronic display panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 1A is a graph of input and output grayscales according to the related art;

FIG. 1B is a view showing an original image sample with a grayscale gradually increasing toward the center in red, green, blue, and white regions according to the related art;

FIG. 8A-FIG. 8F shows images obtained from a test according to the data clipping method of the exemplary embodiment;

DETAILED DESCRIPTION

Figure 2A:
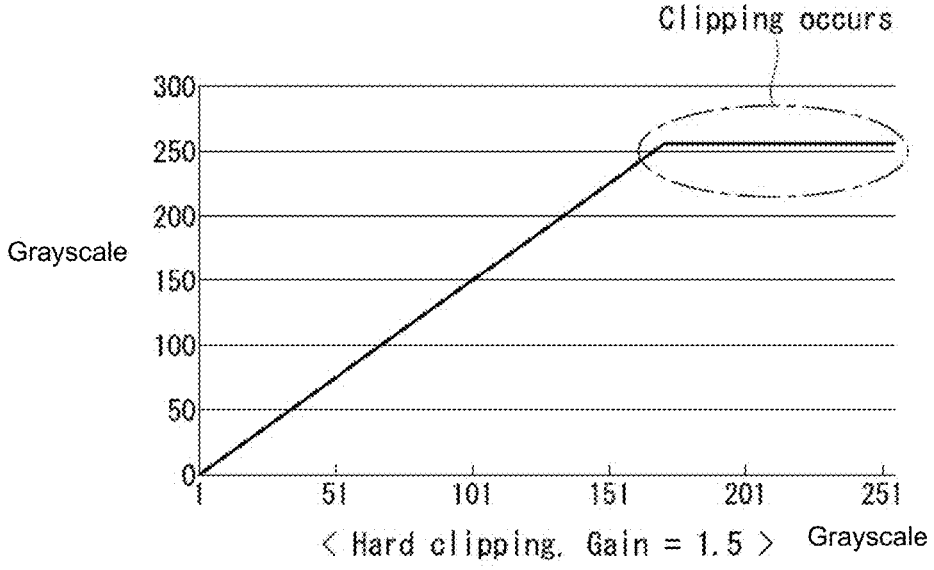
FIG. 2A (RELATED ART)
FIG. 2A and FIG. 2B are views showing hard clipping of the original image of FIG. 1B according to the related art.
Figure 2B:
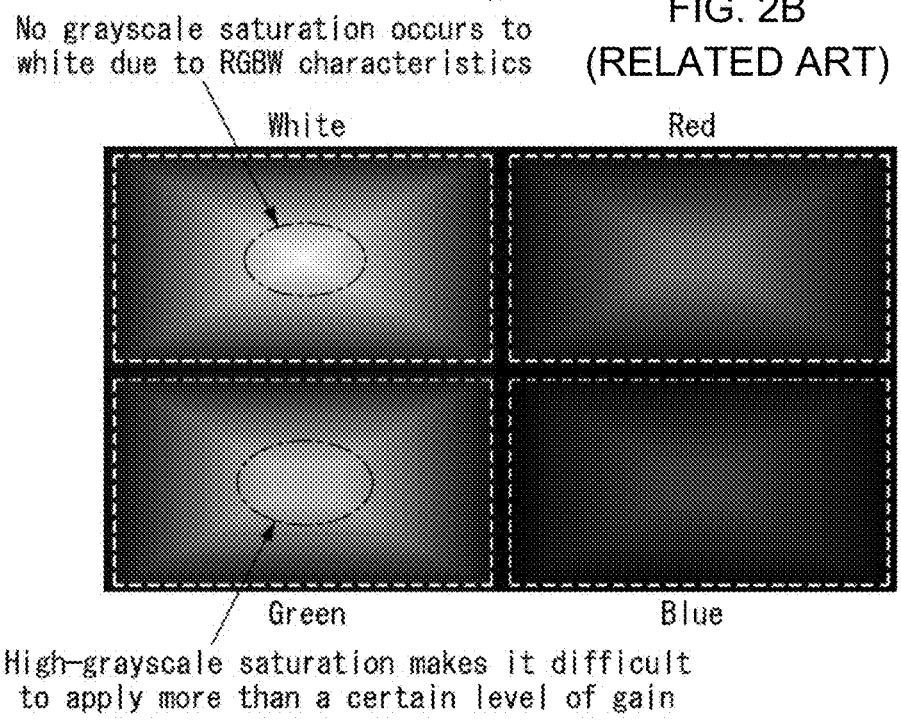
FIG. 2B (RELATED ART)
Figure 3A:
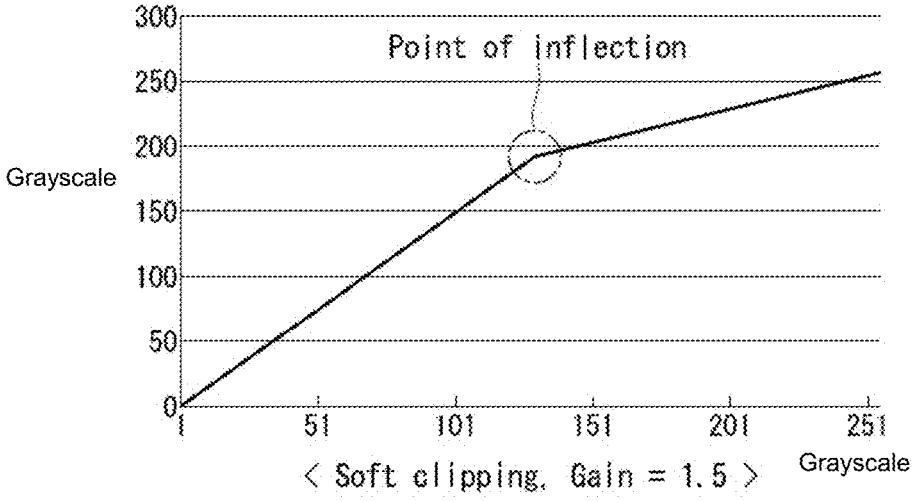
FIG. 3A (RELATED ART)
FIG. 3A and FIG. 3B are views showing soft clipping of the original image of FIG. 1B according to the related art.
Figure 3B:
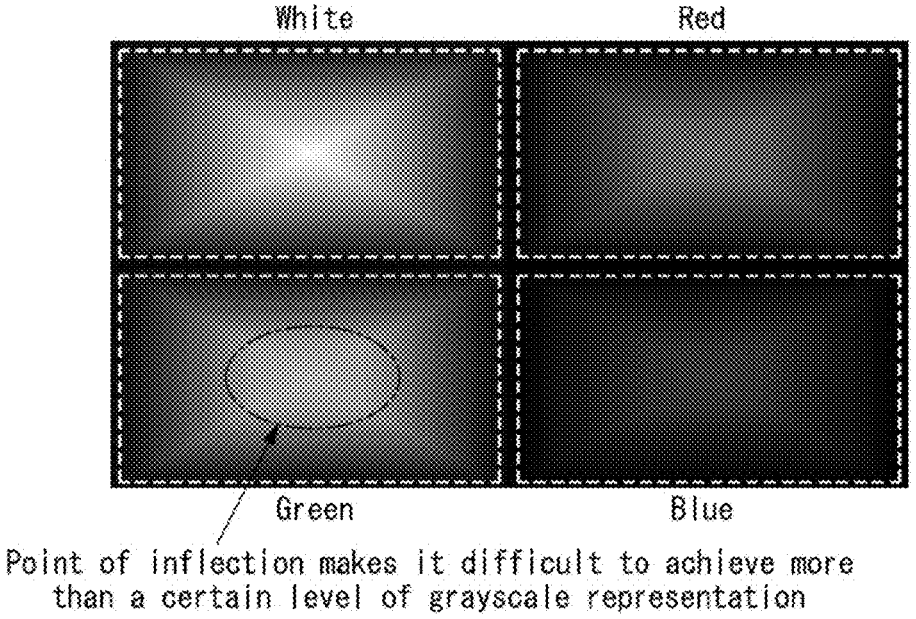
FIG. 3B (RELATED ART)
Figure 4:
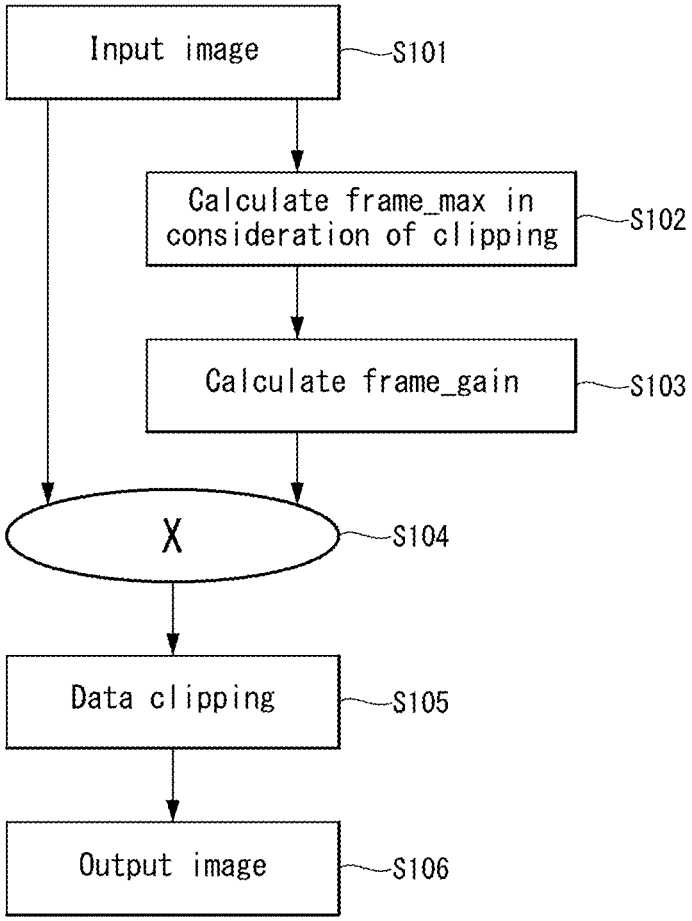
FIG. 4 (RELATED ART)
FIG. 4 is a flowchart showing a conventional data clipping method according to the related art.
Figure 5:
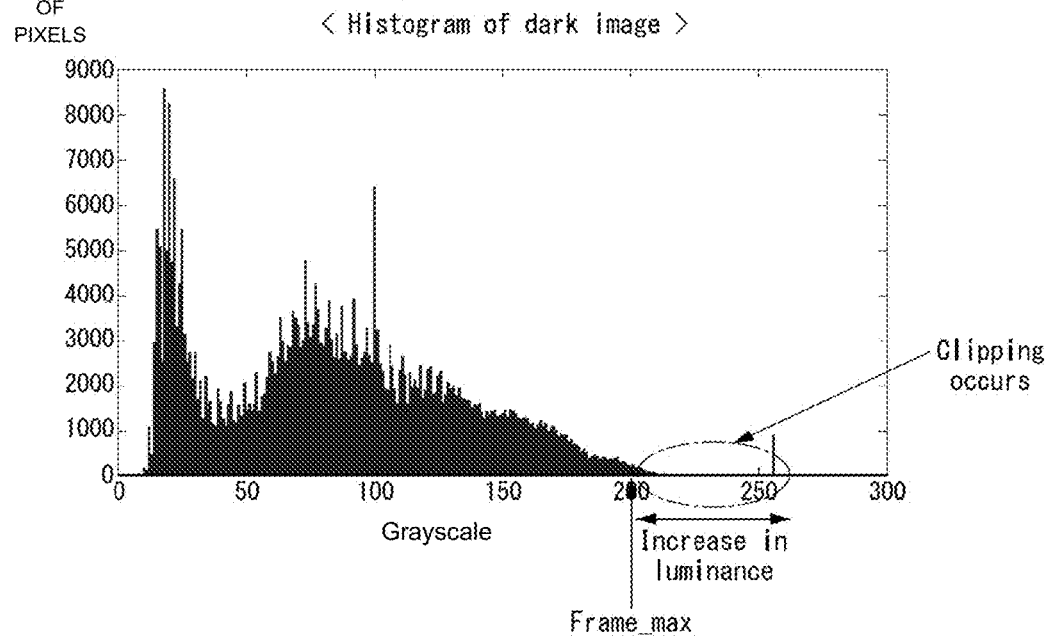
FIG. 5 (RELATED ART)
FIG. 5 is an example of a histogram of a dark image according to the related art.
Figure 6:
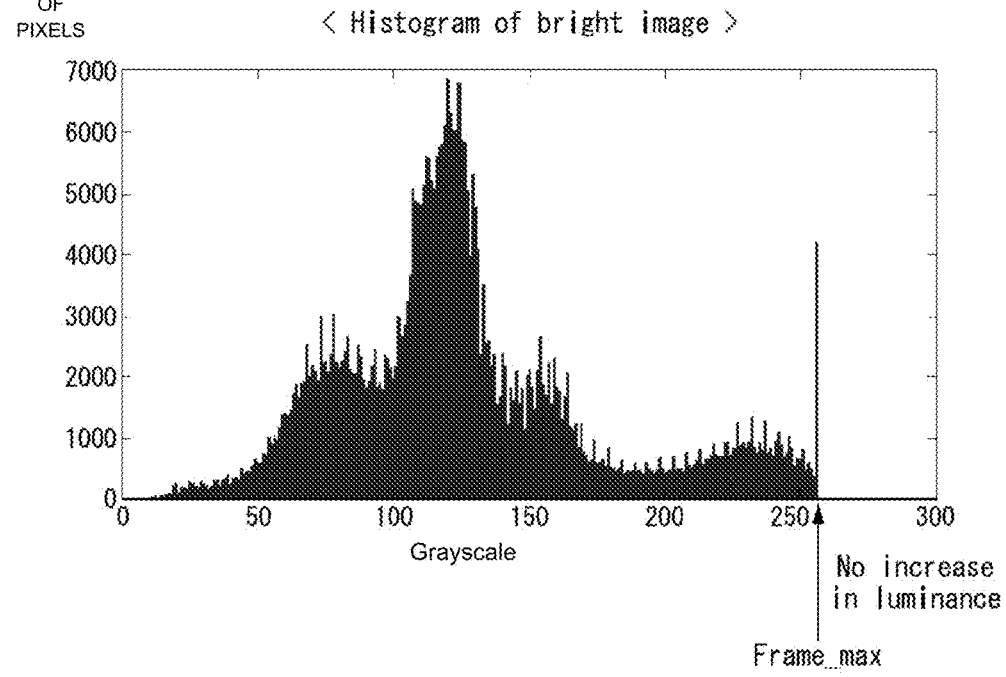
FIG. 6 (RELATED ART)
FIG. 6 is an example of a histogram of a bright image according to the related art.

Hereinafter, exemplary embodiments of the present invention will be described in detail with reference to the accompanying drawings. Like reference numerals refer to like elements throughout the specification. In the following description, detailed descriptions of well-known functions or configurations will be omitted where they may unnecessarily obscure the subject matters of the invention.

A display device of an exemplary embodiment may be implemented as a flat-panel display including white sub-pixels in addition to red, green, and blue sub-pixels in one pixel. For example, the display device may be a Red, Green, Blue, and White (an RGBW-type) liquid crystal display (LCD) or an RGBW-type organic light emitting diode (OLED) display. A data clipping method of the disclosed embodiment improves grayscale saturation in a high-grayscale region and further enhances the luminance of pixels by adding a luminance increment, Wadd, (to be described below) to White (W) data of each pixel. Moreover, this data clipping method improves the luminance of pixels without desaturation by controlling the total amount of W data in one frame image.

The disclosed data clipping method allows for higher luminance representation, which is not achieved by RGB sub-pixels alone, by adjustment of W data to be written to a W sub-pixel, in order to reduce grayscale saturation of clipped RGB data.

In the data clipping method as disclosed, using the following Equation 1, high grayscale data is clipped from an input image, and RGB data is modulated by multiplying the clipped data of the input image by a gain. Then, in the data clipping method, a luminance increment, Wadd, is calculated based on the result of subtracting the clipped data from each of the modulated RGB data, as shown in Equation 1, and adding the luminance increment, Wadd, to the W data. Using Equation 1 is a method of calculating the luminance increment, Wadd, to be added to the W data of a pixel.

$$W_{add}=((R_{in}*\text{gain}-R_{clip})*R_{RATIO}+(G_{in}*\text{gain}-G_{clip})*G_{RATIO}+(B_{in}*\text{gain}-B_{clip})*B_{RATIO})*W_{RATIO} \quad \text{Equation 1:}$$

where, $W_{RATIO}=W_{RATIO_{pre}}-(W_{total}-W_{MAX})*\text{alpha}$, where gain is frame gain; $R_{in}$, $G_{in}$, and $B_{in}$ are red, green, and blue data (hereinafter, 'RGB data') of the input image; $R_{clip}$, $G_{clip}$, and $B_{clip}$ are RGB data clipped from the input image histogram at grayscales above the maximum frame value; $R_{RATIO}$, $G_{RATIO}$, and $B_{RATIO}$ are constants and the ratios with which to calculate luminance increments for RGB data; $W_{total}$ the sum of every $W_{add}$ included in the current frame, i.e., an N-th frame (N is a positive integer); $W_{MAX}$ is the sum of every $W_{add}$ to be permitted, which is a threshold at which an observer perceives no saturation, defined through a test in consideration of the type and driving characteristics of the particular display device; $W_{RATIOpre}$ is the $W_{RATIO}$ of the previous frame, i.e., an (N−1)-th frame; and α(alpha) is the coefficient of a temporal filter, which is a constant for adjusting the rate of change of W data between frames of $W_{RATIO}$, α(alpha) is a constant at which an observer perceives no flicker caused by an abrupt change of W data, which is obtained experimentally and in the range from 0 to 1.

Figure 7:
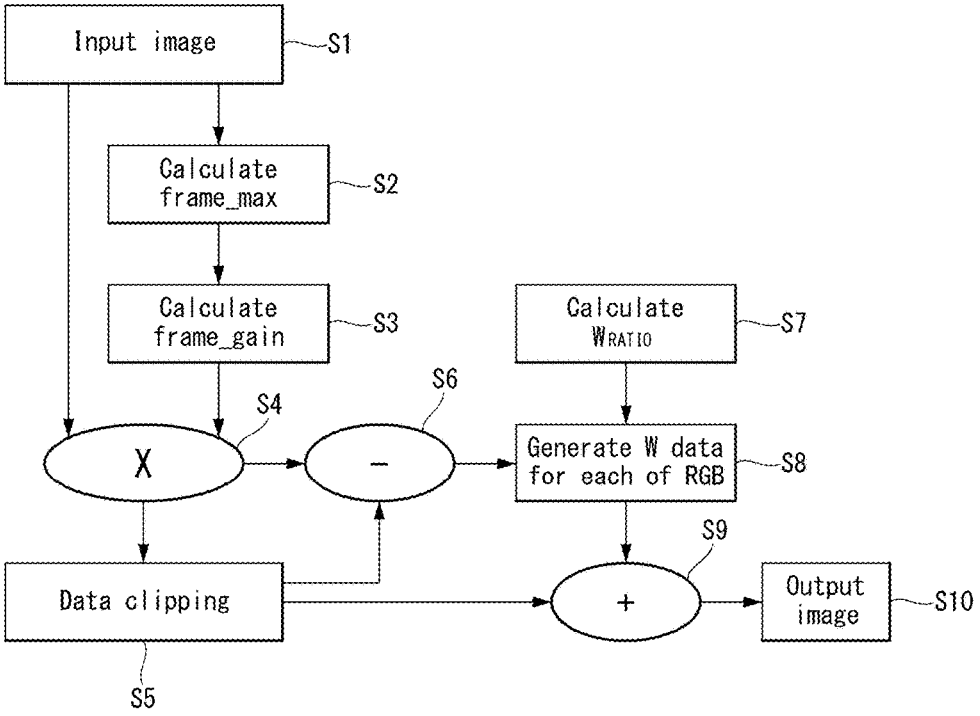
FIG. 7 is a flowchart showing a data clipping method according to an exemplary embodiment of the present invention.

In this data clipping method, an operation is performed as shown in FIG. 7. Here, calculation of W data is according to Equation 1.

Referring to FIG. 7, in the data clipping method, when an input image is received, the histogram of this image is created, and the maximum frame value, frame_max, is calculated from the histogram in anticipation of pixel data clipping (S1 and S2). The maximum frame value may be calculated by counting the cumulative number of pixels for each grayscale, from the highest grayscale of the histogram to lower grayscales, and comparing the count with a predetermined threshold. The predetermined threshold is a value at which an observer perceives no saturation, defined through testing in consideration of the type and driving characteristics of the particular display device. If the count exceeds the threshold, the last grayscale just before the count value exceeds the threshold may be defined as the maximum frame value. The method of calculating the maximum frame value depends on whether it is hard-clipping or soft-clipping, or another clipping curve may be used.

Next, in this embodied data clipping method, the frame gain, frame_gain, is calculated by dividing the highest grayscale, i.e., 255, of the pixel data by the maximum frame value, frame_max (S3); RGB pixel data is modulated by multiplying the input pixel data by the frame gain, frame_gain (S4); and then the pixel data of the input image is clipped (S5). The clipped data can be represented by Equation (Din*frame_gain)−Dout. Din is input data, and Dout is data at the highest grayscale, 255, of output data.

In this data clipping method, Rin*gain−Rclip, Gin*gain−Bclip, and Bin*gain−Bclip of Equation 1 are calculated by subtracting clipped data from input data multiplied by the frame gain (S6). Next, in the data clipping method, $W_{RATIO}$ is calculated based on Equation 1 to determine the luminance increment Wadd for each pixel (S7), and the luminance increment, Wadd, is added to the W data to create W data with a higher luminance (S8). Next, in the data clipping method, the clipped data and the W data are combined (S9) to output RGBW data (S10).

$W_{RATIO}$ is calculated in the above Equation, and in step S8, Wadd is calculated. In step S9, an output image is obtained by adding Wadd to the W data together with the calculation results ($R_{clip}$, $G_{clip}$, $B_{clip}$) from step S5. That is, this is a calculation to generate the combined output (S10). Thus, the output data (S10) includes $R_{clip}$, $G_{clip}$, $B_{clip}$, and W data+Wadd. Here, W data=$\text{Wdata}_{original}$+Wadd, where $\text{Wdata}_{original}$ is W data obtained from the RGB data of the input image.

FIG. 8A-FIG. 8F illustrates a visual example of the disclosed clipping method. FIG. 8A-FIG. 8F shows images obtained from a test image according to the disclosed data clipping method. An image in FIG. 8A is divided into four regions: R, G, B, and W regions, which is the same original test image as shown in FIG. 1B. The W region is an achromatic region of white light from the W sub-pixel, and the RGB regions are chromatic regions. The grayscale at the outermost edge of each of the R, G, B, and W regions of the original image is 0. The grayscale gradually increases toward the center, and the pixel data at the center of each region has the highest grayscale 255. The image in (b) of FIG. 8B is of RGB data obtained by multiplying the data of the original image by the frame gain, frame_gain. The image in FIG. 8C is a clipped image. The image in FIG. 8D is an image obtained by subtracting FIG. 8C from FIG. 8B. The image in FIG. 8D is represented by (Rin*gain−Rclip), (Gin*gain−Gclip), and (Bin*gain−Bclip) of Equation 1. As illustrated in FIG. 8D, the W region shows no grayscale saturation after the data clipping, whereas the RGB regions show grayscale saturation after the data clipping. The image in FIG. 8E is an image obtained by multiplying FIG. 8D by RGB ratios, multiplying the sum of this product by $W_{RATIO}$ to calculate Wadd, and adding Wadd to the original W data. The image in FIG. 8F is an image obtained by FIG. 8C+FIG. 8E.

Hereinafter, the embodied data clipping method will be described in further detail with reference to FIGS. 9 to 12.

Figure 9:
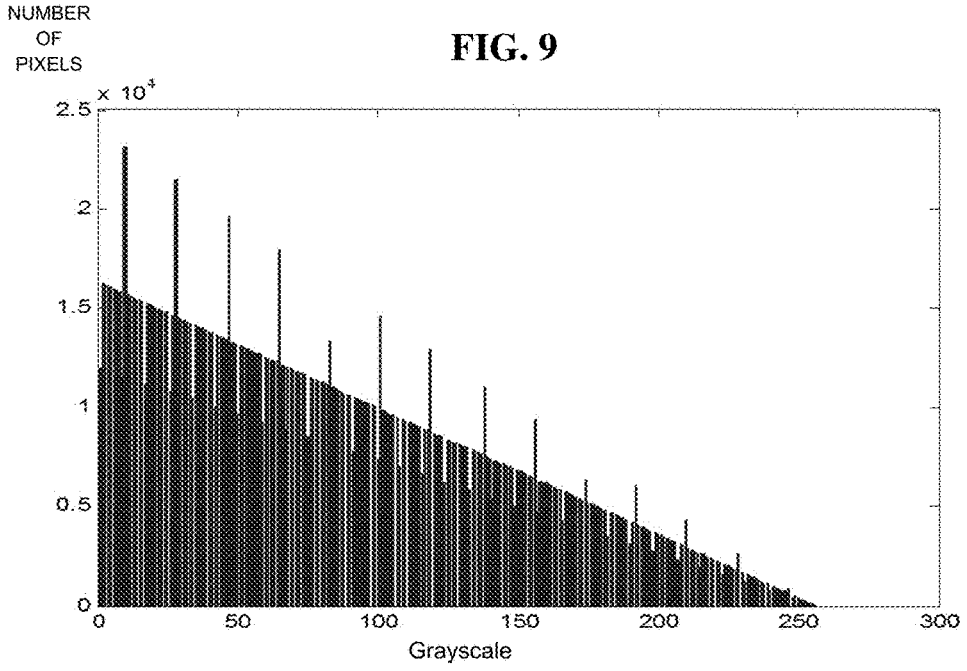
FIG. 9 is a histogram of the original image of FIG. 8A.
Figure 10:
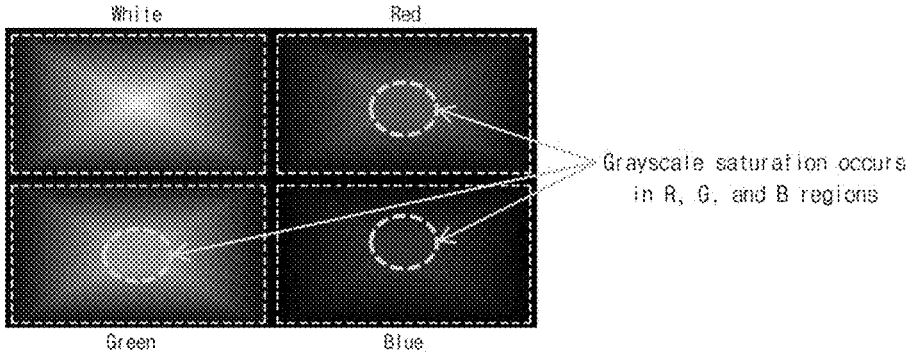
FIG. 10 is a view showing an example of grayscale saturation of RGB data that occurs when data of the original image is multiplied by a frame gain.

FIG. 9 is a histogram of the original input image of FIG. 8A. FIG. 10 is a view showing an example of grayscale saturation of RGB data that occurs when data of the original image is multiplied by a frame gain.

The W data is calculated by adding Wadd to $\text{Wdata}_{original}$, which is generated from the RGB of the input image. A white gain calculated from the RGB may be multiplied to $\text{Wdata}_{original}$. Because the result obtained by multiplying a gain to each of RGB is reflected in Wadd, the gain of each of RGB is reflected in RGB.

In this data clipping method, such a histogram as shown in FIG. 9 is created for an input image, the maximum frame value, frame_max, is determined in consideration of pixel grayscale data to be clipped from the histogram, and a frame gain, frame_gain, is calculated based on the maximum frame value frame_max.

In this data clipping method, every data in the RGB input image is multiplied by a gain. Then, grayscale saturation occurs in chromatic regions like RGB regions, as shown in FIG. 10. To reduce such grayscale saturation, clipped data is calculated first according to this data clipping method. For example, if the value of the data modulated by multiplying the grayscale of the input data by the frame gain is 280, the clipped data is 280(=Din*frame_gain)−255(=Dout)=25(=clipped data). Next, in the data clipping method, the luminance increments W for RGB colors are calculated by multiplying the clipped RGB data by RGB ratios (constants).

According to experimentation results with respect to a display panel, $R_{RATIO}$, $G_{RATIO}$, $B_{RATIO}$ are determined as constant values for obtaining luminance enhancement without a visual artifact. These constant values may vary according to display panels or models, without being limited to a specific value.

For example, if the gained value of R data (280) exceeds the highest grayscale value 255, R=280 is substituted by R=255. The luminance increment WR for R is calculated by multiplying the clipped R data by the luminance ratio $R_{RATIO}$ for R. WR=25 (=clipped data)*0.1 (=$R_{RATIO}$)=2.5.

If the gained value of G data (280) exceeds the highest grayscale value 255, G=280 is substituted by G=255. The luminance increment WG for G is calculated by multiplying the clipped G data by the luminance ratio $G_{RATIO}$ for G. WG=25 (=clipped data)*0.2 (=$G_{RATIO}$)=5.

If the gained value of B data (280) exceeds the highest grayscale value 255, B=280 is substituted by B=255. The luminance increment WB for B is calculated by multiplying the clipped B data by the luminance ratio $B_{RATIO}$ for B. WB=25 (=clipped data)*0.1 (=$R_{RATIO}$)=2.5.

$W_{total}$ in Equation 1 is calculated as the sum WR+WG+WB for every pixel data within 1 frame. Once $W_{total}$ is calculated, $W_{RATIO}$ of the current frame is calculated based on the constants (WMAX, alpha) and the $W_{RATIOpre}$ from the previous frame. $W_{RATIO}$ is then used to calculate the luminance increment Wadd for each pixel, per Equation 1.

If $W_{total}$ is greater than $W_{MAX}$, desaturation may occur. Thus, the luminance ratios for RGB are decreased to $R_{RATIO}'$, $G_{RATIO}'$, and $B_{RATIO}'$, as shown in the following example. Accordingly, the disclosed data clipping method improves the luminance of pixels without desaturation by controlling the total amount of W data in 1 frame image.

$$WR=25*0.05(=RRATIO')=1.25$$

$$WG=25*0.1(=GRATIO')=2.5$$

$$WB=25*0.05(=BRATIO')=1.25$$

Chroma is degraded when $W_{total}$ is greater than $W_{MAX}$, and thus, WR, WG, and WB are adjusted by lowering $RGB_{RATIO}$ to $RGB_{RATIO}'$. Thus, when $W_{total}$ is not greater than $W_{MAX}$, $RGB_{RATIO}$ is not corrected to $RGB_{RATIO}'$.

Figure 11:
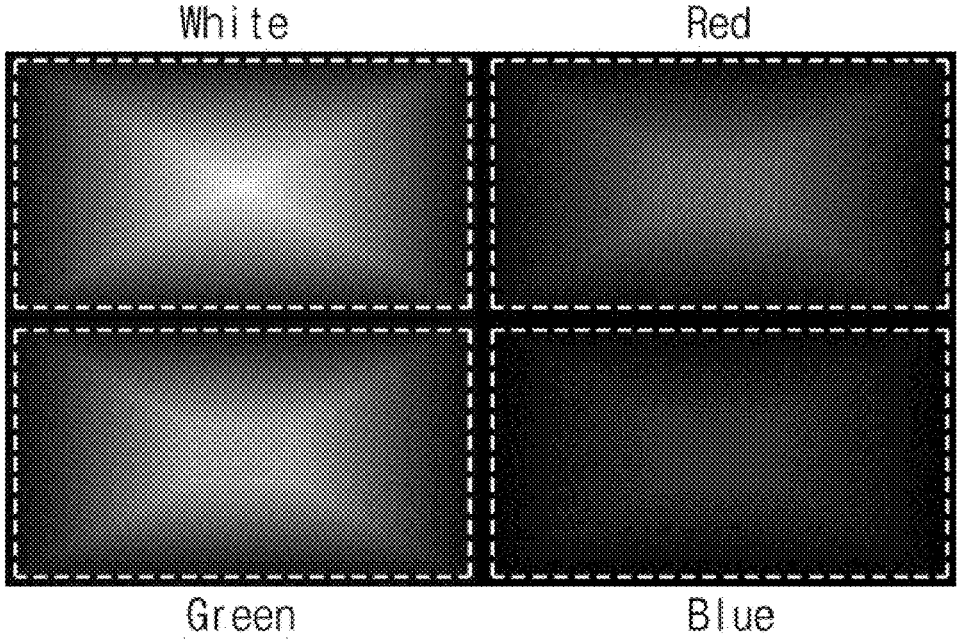
FIG. 11 is an enlarged view of FIG. 8C.
Figure 12:
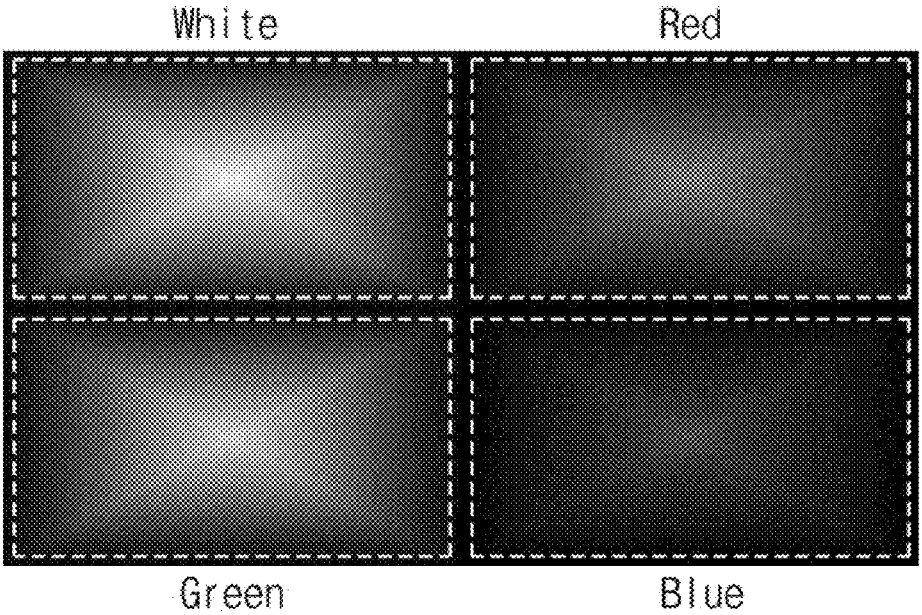
FIG. 12 is an enlarged view of FIG. 8F.

FIG. 11 is an image obtained after data clipping has occurred in the original image of FIG. 8A. FIG. 11 is an enlarged view of FIG. 8C. FIG. 12 is an image obtained by adding a luminance increment Wadd to W data of the data-clipped image of FIG. 11. FIG. 12 is an enlarged view of FIG. 8F.

Figure 13:
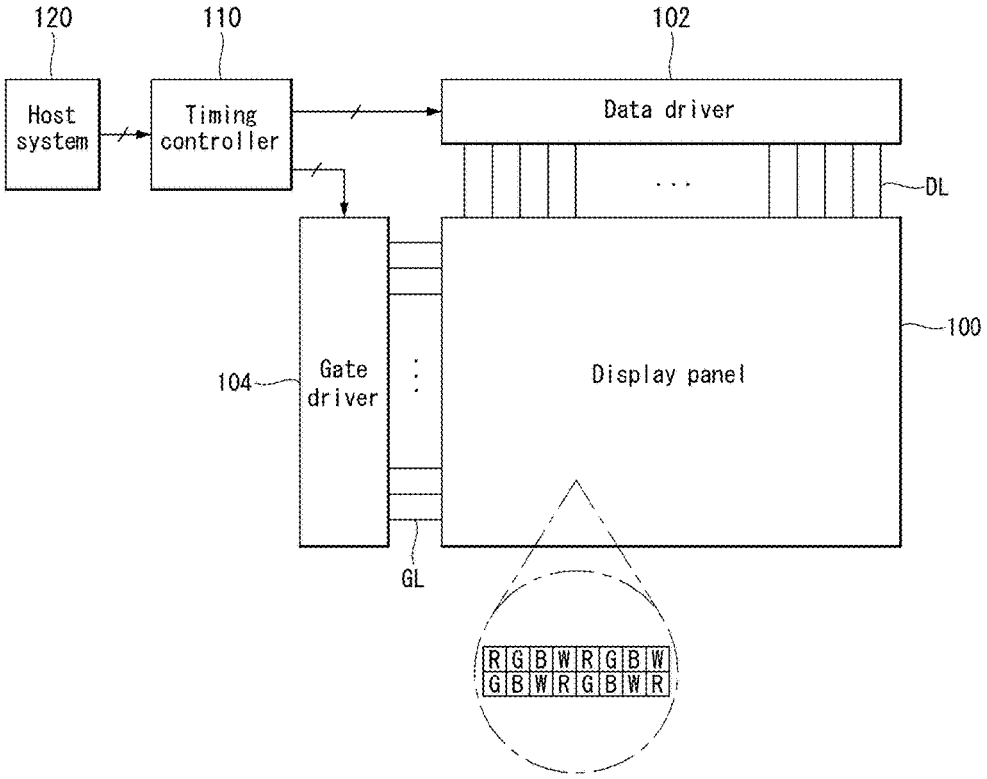
FIG. 13 is a view showing a display device according to an exemplary embodiment.

FIG. 13 is a view showing a display device according to an exemplary embodiment of the present invention.

Referring to FIG. 13, the display device comprises a display panel 100, a display panel data driver 102, a display panel gate driver 104, a timing controller 110, and a host system 120.

A pixel array of the display panel 100 comprises data lines DL, gate lines (or scan lines GL) crossing the data lines DL, and pixels arranged in a matrix form to display an input image. Each pixel comprises an R sub-pixel, a G sub-pixel, a B sub-pixel, and a W sub-pixel. R data is written to the R sub-pixel, G data is written to the G sub-pixel, B data is written to the B sub-pixel, and W data is written to the W sub-pixel. A luminance increment Wadd generated by the above-described data clipping method is added to the W data.

The display panel driver writes RGBW data to the pixels of the display panel 100. The display panel driver comprises a data driver 102, a gate driver 104, and a timing controller 110.

The data driver 102 converts modulated digital video data received from the timing controller 110 to a gamma compensation voltage to generate data voltages, and supplies the data voltages to the data lines DL of the display panel 100. The gate driver 104 supplies the gate lines GL with gate pulses synchronized with the data voltages supplied to the data lines DL, under control of the timing controller 130, and sequentially shifts the gate pulses.

The timing controller 110 converts RGB data of an input image received from a host system 120 to RGBW data. The timing controller 110 comprises a data clipping module that executes the above-described data clipping method. The data clipping module creates a luminance increment Wadd, which is calculated according to Equation 1, adds the luminance increment Wadd to Wdata, and transmits the modulated RGB data to the data driver 102.

The timing controller 110 may convert RGB data of an input image to RGBW data based on color spectrum exchange by using a white gain calculation algorithm. Any well-known white gain calculation algorithm can be used. For instance, the white gain calculation algorithms proposed in Korean Patent Applications NOs. 10-2005-0039728 (May 12, 2005), 10-2005-0052906 (Jun. 20, 2005), 10-2005-0066429 (Jul. 21, 2007), and 10-2006-0011292 (Feb. 6, 2006) filed by the present inventor are applicable. White light generated from a white (W) sub-pixel comprises light of R, G, and B wavelengths. The light from RGB sub-pixels for displaying input RGB data and the light from RGBW sub-pixels for displaying RGBW data after conversion must be exactly the same. As for the spectrum exchange, W data to be written to the W sub-pixel is generated, and RGB data to be written to the RGB sub-pixels is subtracted, in order to reduce the amount of light of RGB wavelengths of the RGB sub-pixels by the amount of light of RGB wavelengths generated from the W sub-pixel.

The timing controller 110 controls the operation timings of the data driver 110 and gate driver 104 by using timing signals, such as a vertical synchronization signal, horizontal synchronization signal, data enable signal, and main clock, synchronized with digital video data and received from the host system 120.

The host system 120 may be a TV (television) system, a navigation system, a DVD player, a Blu-ray player, a personal computer (PC), a home theater system, a phone system, or the like. The host system 120 may use a scaler to convert input image into a format suitable for the resolution of the display panel 100 and transmit it to the timing controller 110 together with a timing signal.

In the case of a liquid crystal display, the display panel 100 may be implemented in any well-known liquid crystal mode, such as a TN (Twisted Nematic) mode, a VA (Vertical Alignment) mode, an IPS (In-Plane Switching) mode, and an FFS (Fringe Field Switching) mode. The liquid crystal display may be implemented in various forms including a transmissive liquid crystal display, a semi-transmissive liquid crystal display, and a reflective liquid crystal display. The transmissive liquid crystal display or the semi-transmissive liquid crystal display comprises a backlight unit and a light source driver.

The backlight unit may be implemented as an edge-type backlight unit or a direct-type backlight unit. The backlight unit may be under the back of the display panel to irradiate light to the display panel. The light source driver supplies current to the light sources of the backlight unit to make the light sources emit light. The light source driver adjusts the luminance of the light sources by adjusting the current applied to the light sources in response to a dimming signal from a backlight controller. The light sources may be implemented as LEDs (light emitting diodes).

The timing controller 110 lowers the luminance of the backlight by 1/S or less by adjusting the dimming signal based on a frame gain S. Accordingly, the luminance of the backlight is adjusted by the reciprocal of the frame gain S, thereby reducing the power consumption of the liquid crystal display.

As described above, in the data clipping method and the display device using the same according to the present embodiment, when data is multiplied by a gain because of data clipping of an input image, the luminance increment of W data is calculated in consideration of the amount of RGB data clipping, and the luminance increment is added to the W data. As a consequence, the display device can reduce high grayscale saturation when data is clipped, further increase the luminance of pixels at lower grayscales by further increasing the frame gain, and control luminance increases without a change in saturation.

Although embodiments have been described with reference to a number of illustrative embodiments thereof, it should be understood that numerous other modifications and embodiments can be devised by those skilled in the art that will fall within the scope of the principles of this disclosure. More particularly, variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A data clipping method for an electronic display device comprising:

inputting grayscales of Red (R), Green (G), Blue (B) and White (W) input image data for RGBW sub-pixels of the electronic display device;

modulating the RGB input image data by multiplying the RGB input image data by a gain to obtain RGB modulated data;

clipping the RGB modulated data into RGB clipped data by reducing corresponding data at grayscales;

determining a luminance increment by adding the clipped data from each of modulated RGB data;

adding the luminance increment to W data; and writing the W data to a W sub-pixel.

2. The data clipping method of claim 1, wherein, the luminance increment, Wadd, is calculated by the following equation:

$$W_{add}((R_{in}*\text{gain}-R_{clip})*R_{RATIO}+(G_{in}*\text{gain}-G_{clip})*G_{RATIO}+(B_{in}*\text{gain}-B_{clip})*B_{RATIO})*W_{RATIO}$$

where, $W_{RATIO}=W_{RATIO_{pre}}-(W_{total}-W_{MAX})*\text{alpha}$, where gain is frame gain, $R_{in}$, $G_{in}$, and $B_{in}$ are red, green, and blue data (hereinafter, 'RGB data') of the input image; $R_{clip}$, $G_{clip}$, and $B_{clip}$ are RGB data clipped from a histogram at grayscales above a maximum frame value; $R_{RATIO}$, $G_{RATIO}$, and $B_{RATIO}$ are predetermined ratios with which to calculate luminance increments for RGB data; $W_{total}$ sum of every $W_{add}$ included in a current frame of an input image, $W_{MAX}$ is a sum of every $W_{add}$ to be permitted, $W_{RATIOpre}$ is a $W_{RATIO}$ of a previous frame, and α(alpha) is a predetermined constant coefficient of a temporal filter, which is in a range from 0 to 1.

3. The data clipping method of claim 1, wherein, if the modulated R data exceeds the highest grayscale value, the modulated R data is substituted by the highest grayscale, and a red luminance increment is obtained by multiplying the clipped R data by a red luminance ratio, if the modulated G data exceeds the highest grayscale value, the modulated G data is substituted by the highest grayscale, and a green luminance increment is obtained by multiplying the clipped G data by a green luminance ratio, if the modulated B data exceeds the highest grayscale value, the modulated B data is substituted by the highest grayscale, and a blue luminance increment is obtained by multiplying the clipped B data by a blue luminance ratio, and $W_{total}$ is calculated as the sum of the red luminance increment, the green luminance increment, and the blue luminance increment.

4. The data clipping method of claim 3, wherein, if $W_{total}$ is greater than $W_{MAX}$, the red luminance increment, the green luminance increment, and the blue luminance increment are decreased.

5. A display device comprising:

a display panel including a plurality of pixels in a matrix, each pixel comprising a Red (R) sub-pixel, a Green (G) sub-pixel, a Blue (B) sub-pixel, and a White (W) sub-pixel; and a display panel driver for writing RGBW data to the pixels of the display panel, wherein the display panel driver clips grayscales from an input image, modulates RGBW data of the input image by multiplying clipped data of the input image by a gain, and creates a luminance increment based on the result of subtracting the clipped data from the modulated RGB data, and adds the luminance increment to the W data to be written to a W sub-pixel.

6. The display device of claim 5, wherein the display panel is for an RGBW-type liquid crystal display device or an RGBW-type organic light emitting diode display device.

7. A method of supplying clipped data to an electronic display device that includes red (R), green (G), blue (B), and white (W) sub-pixels of an electronic display panel, comprising:

inputting grayscale Red, Green, and Blue (RGB) input image data into the electronic display device;

generating RGBW image data from the RGB input image data;

multiplying the RGBW image data by a frame gain to calculate RGB modulated data;

clipping the RGB modulated data by setting RGB data at a grayscale above a predetermined grayscale to be equal to data at a maximum grayscale to generate RGB clipped data;

subtracting the RGB clipped data from the RGB modulated data to calculate RGB output data;

generating a luminance increment based on the RGB output data;

adding the luminance increment to the W data to calculate W output data;

combining RGB output data with W output data; and outputting the RGBW output data to the electronic display panel.

8. The method of claim 7, wherein, the luminance increment, Wadd, is calculated by the following equation:

$$W_{add}=((R_{in}*\text{gain}-R_{clip})*R_{RATIO}+(G_{in}*\text{gain}-G_{clip})*G_{RATIO}+(B_{in}*\text{gain}-B_{clip})*B_{RATIO})*W_{RATIO}$$

where, $W_{RATIO}=W_{RATIO_{pre}}-(W_{total}-W_{MAX})*\text{alpha}$, where gain is frame gain, $R_{in}$, $G_{in}$, and $B_{in}$ are red, green, and blue data (hereinafter, 'RGB data') of the input image; $R_{clip}$, $G_{clip}$, and $B_{clip}$ are RGB data clipped from a histogram at grayscales above a maximum frame value; $R_{RATIO}$, $G_{RATIO}$, and $B_{RATIO}$ are predetermined ratios with which to calculate luminance increments for RGB data; $W_{total}$ is a sum of every $W_{add}$ included in a current frame of an input image, $W_{MAX}$ is a sum of every $W_{add}$ to be permitted, $W_{RATIOpre}$ is a $W_{RATIO}$ of a previous frame, and α(alpha) is a predetermined constant coefficient of a temporal filter, which is in a range from 0 to 1.

* * * * *